US005102126A

United States Patent [19]

Nguyen

[11] Patent Number: 5,102,126

[45] Date of Patent: Apr. 7, 1992

[54] AIRPLANE FLYING GAME

[76] Inventor: Hoang V. Nguyen, 89-25 Elmhurst Ave., Apt. 203, Elmhurst, N.Y. 11373

[21] Appl. No.: 363,426

[22] Filed: Jun. 5, 1989

Related U.S. Application Data

[63] Continuation of Ser. No. 129,647, Dec. 7, 1987, abandoned, which is a continuation of Ser. No. 795,900, Jul. 11, 1985, abandoned.

[51] Int. Cl.[5] ..... A63H 30/02

[52] U.S. Cl. ..... 273/454; 446/30; 472/11; 472/9; 472/10

[58] Field of Search ..... 273/1 GA, 1 GB, 1 GC, 273/1 GG; 446/30-33, 228, 229; 434/31-34; 272/31 A, 31 B

[56] References Cited

U.S. PATENT DOCUMENTS

| | | | |
|---|---|---|---|
| 1,561,073 | 11/1925 | Hanson | 272/31 A |
| 2,128,690 | 8/1938 | Burke et al. | 434/32 |
| 4,037,358 | 7/1977 | Rosenbaum | 446/30 |

FOREIGN PATENT DOCUMENTS

| | | | |
|---|---|---|---|
| 457556 | 1/1927 | Fed. Rep. of Germany | 273/31 A |
| 298851 | 11/1928 | United Kingdom | 273/1 GA |

*Primary Examiner*—Paul E. Shapiro

[57] ABSTRACT

A toy game consists of a map hung beneath a ceiling or a pole, a model aircraft suspended from a map by flexible, plastic string, and a double remote control—one for flight control and another for altitude control. It is operated indoors or outdoors. The aircraft maneuvers including take-off, climb, descent, and landing are controlled by operators. The system consists of tracks in hanger going along the border of the map of the United States of America, an upper motor, a lower motor in fuselage of aircraft, wheels, wired-plastic string, a battery box, bulbs, electric wires and cables. The upper motor is used for propelling to simulate an aircraft flight with all features along border for locating states and cities. The lower motor is used to make altitude changes. The purpose of AIRPLANE FLYING GAME is to help memorizing the location of states and cities. It is an entertainment game but an educational toy as well.

19 Claims, 21 Drawing Sheets

FIG. 22
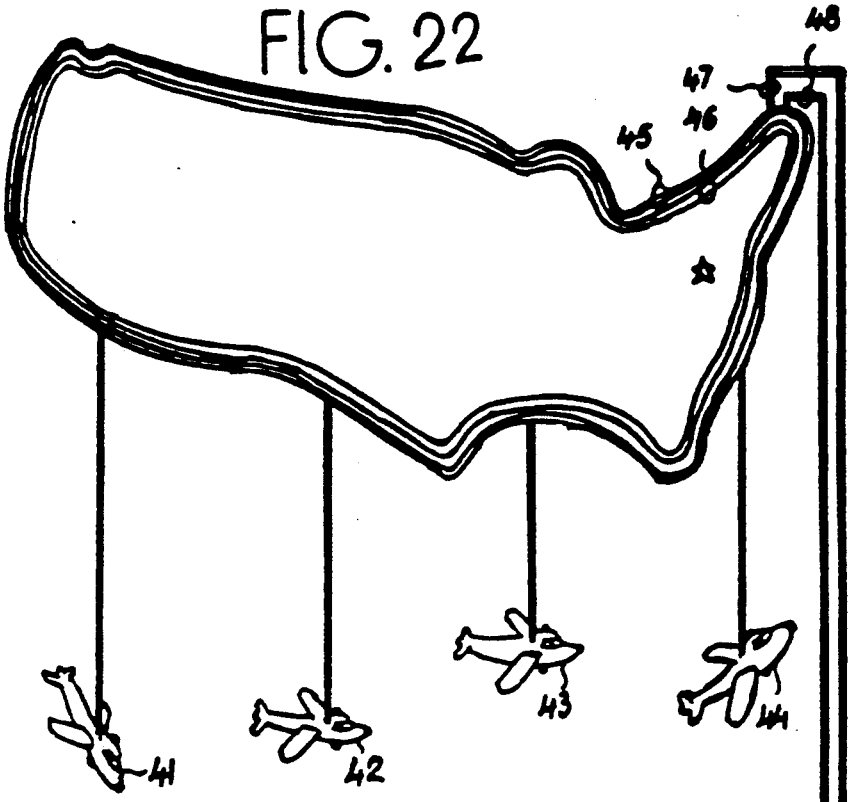
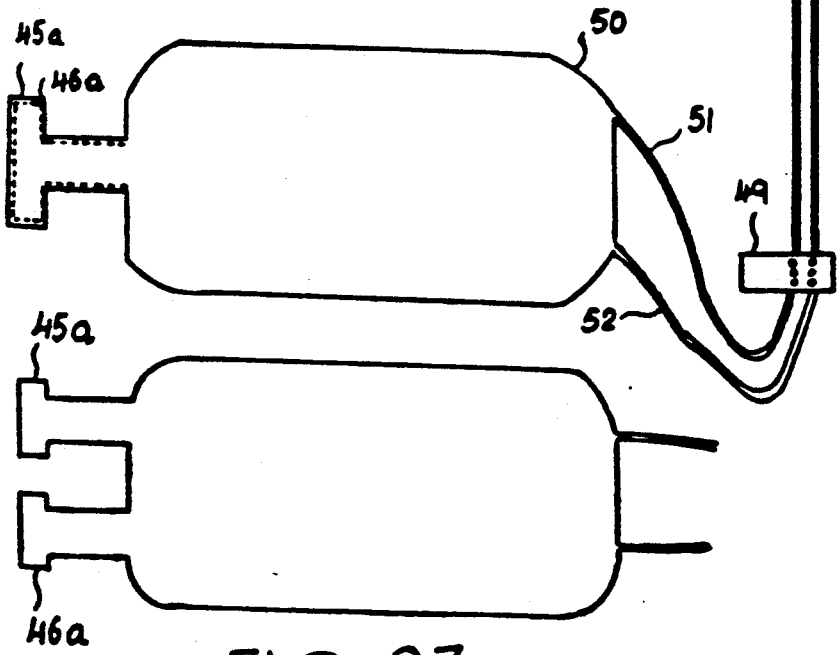
FIG. 23

AIRPLANE FLYING GAME

This application is a continuation of U.S. application Ser. No. 07/129,647 filed on Dec. 7, 1987 which is a continuation of application Ser. No. 06/795,900 filed July 11, 1985, both abandoned.

BACKGROUND OF THE INVENTION

The toy game relates generally to a toy or model aircraft drive and flight controlled by operators. The system includes a map of the United States of America, made of small tubes along the boundaries of states and the border of the United States, hung beneath a ceiling or a pole by small cables on which hanger having the United States shape goes along the border of the map and attached to it by small hooks on tube and allows wheels to be run on pathway inside the hanger to make airplane fly along the border of the United States of America.

While flying, aircraft can be raised or lowered vertically to simulate climb and descent by a flexible, plastic string connected the upper motor to the bottom motor. The upper motor is used to make wheels run inside the hanger that simulate aircraft flying along the border of the United States of America. The motor provides simulation of actual altitude of aircraft while operating such as banking, climbing, descending, landing, and take-off. Toy aircraft has been shown to be played indoors which can be played outdoors as well and truly provides a three-dimensional control and drive of a model airplane to more realistically simulate actual flight conditions of an aircraft such as take-off, changing altitude, landing, and more fun with lights on top, at bottom, and at the nose of aircraft on and off. The invention comprises an inclusive system which provides forward motion for a model aircraft in a flight along the border and pitch and roll maneuvers. The model aircraft attached to and suspended from a vertically flexible string which is connected to a motor inside the aircraft that could be run back and forth for altitude control and to an upper motor that makes wheels running on pathway inside hanger for flight control. Flexible string containing electrical wires let electric power, by the touching of metal tips with metal pieces which houses electrical power at different current, run the motor inside model aircraft to provide changes in rolling and pitching of aircraft while suspended from the flexible string.

Thus utilizing the instant model aircraft control system, an operator may simulate all aircraft altitudes including take-off and landing plus a variety of standard aerobatic flight maneuvers to provide more realism with the use of the toy. The system may also be utilized for teaching aircraft flight maneuvers and learning to locate the states and cities in the United States of America.

SUMMARY OF THE INVENTION

The invention is the strategy of a game and how it is played. The object of the game is to fly a plane along the border of a map which is facing down and attached underside to it with hanger C containing tracks inside. The system is built to simulate the flying of aircraft or make a landing at the location of state which opponents or you have chosen. This will trigger a light on map and lights on aircraft being flashed. AIRPLANE FLYING GAME is a toy game which includes either a made-tube map or a board map of the United States, with its states, a connected hanger going along the border of the country, an aircraft, an upper motor, a lower motor, wheels, a plastic string, a double-button remote control, a battery-powered box, electric wires, bulbs, and cable. AIRPLANE FLYING GAME is designed to be played indoors by hanging on ceiling or outdoors (in garden, on beach) by hanging on a pole.

A toy aircraft flight drive and control system for propelling and simulating aircraft maneuvers comprising a model aircraft containing a motor inside its fuselage connected by a vertically flexible string, suspended from an upper motor that makes wheels run on pathway in hanger simulating actual flight, which is shorter or longer for altitude changes of aircraft. The model aircraft structure itself includes a motor in the fuselage connected with a flexible string that could be rolled back and forth by that motor for altitude control by a remote control. A flight panel includes a remote control for providing the model aircraft with variable speed forward motion, variable speed altitude changes, flight attitude changes along the border of the United States of America for locating the specified state and city.

The model or toy aircraft is thus capable of taxiing, taking off, landing, climbing, diving, straight and level flight, and various two-dimensional flight paths describing sine waves, parabolic and hyperbolic patterns and most standard aerobatic maneuvers and most interesting that is light on top be flashed when plane reaches highest altitude, also altitude changes make lights at nose and certain state, city flash and a complete landing makes both lights at nose, bottom and a specified name for state, city flash.

The smoothness of the flight attitude, profile, and accurate landirg on a specified state will be dependent upon the skill and coordination of the operator. It requires an operator who play the game to know the spot where it could flash the lights at nose, bottom and a specified state.

It is an objective of this invention to provide a model aircraft flight control system for simulating all conventional flight attitudes for a real thing including a take-off, landing, various positions, and basic standard purpose.

It is another objective of this invention is to provide the two-way motion of a motor rolling the flexible string back and forth to make altitude changes.

And still yet another objective of this invention is to provide a model aircraft propulsion system in which the model aircraft is suspended by a flexible string from a map hung beneath a ceiling or a pole and controlled vertically for upward, downward movement.

But still yet another objective of this invention is to provide a model aircraft flight control system for indoors or outdoors use which allows operators to simultaneously provide forward motion, altitude control and aircraft flight attitude control such that aircraft simulates flying without actually having to be flown.

In accordance with these and other objects which will be apparent hereinafter, the instant invention will now be described with particular reference to the accompanying drawings.

BRIEF DESCRIPTION OF THE DRAWINGS

FIG. 22 and FIG. 23 show a view of aircraft in various positions and a hand control.

FIG. 33 shows hanger along the border of the map of the United States of America with its capital and states and a state to be flashed on.

FIG. 33*a* shows a state with its light turned on.

DETAILED DESCRIPTION OF THE PREFERRED EMBODIMENT

We are introducing a toy game for education and entertainment that flies around beneath a hanger having the shape of the border of the United States of America. How does this toy game work? Let us explain the function of each part of the toy in description and tell how it works.

Figure 1:
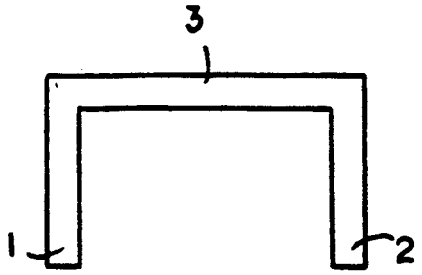
FIG. 1 shows a cut-away hanger.
Figure 2:
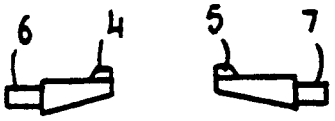
FIG. 2 shows two bars with rails on them.
Figure 3:
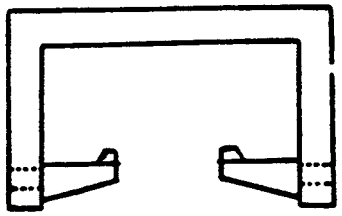
FIG. 3 shows a complete cut-away hanger.
Figure 4:
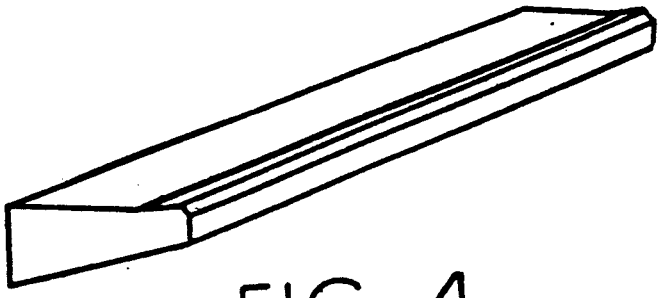
FIG. 4, FIG. 5, and FIG. 6 show bar in different views.
Figure 5:
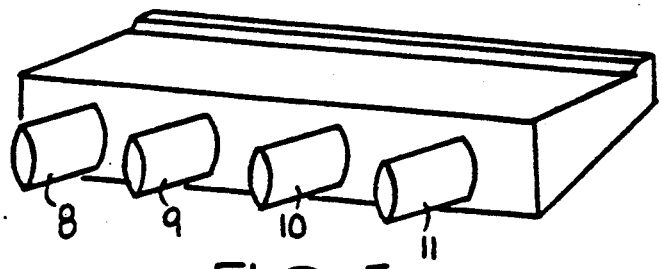
Figure 6:
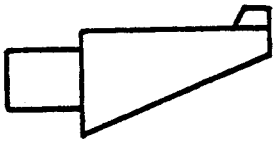
Figure 7:
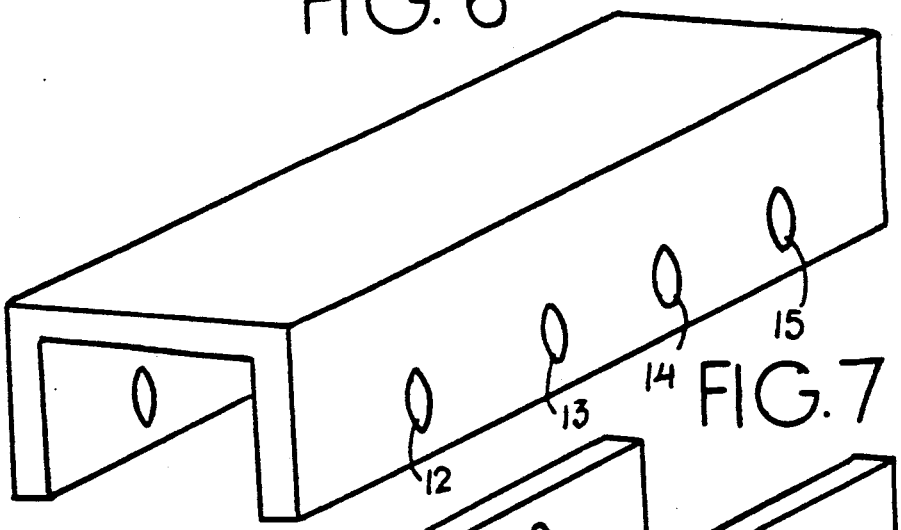
FIG. 7 and FIG. 8 show hanger in different views.
Figure 8:
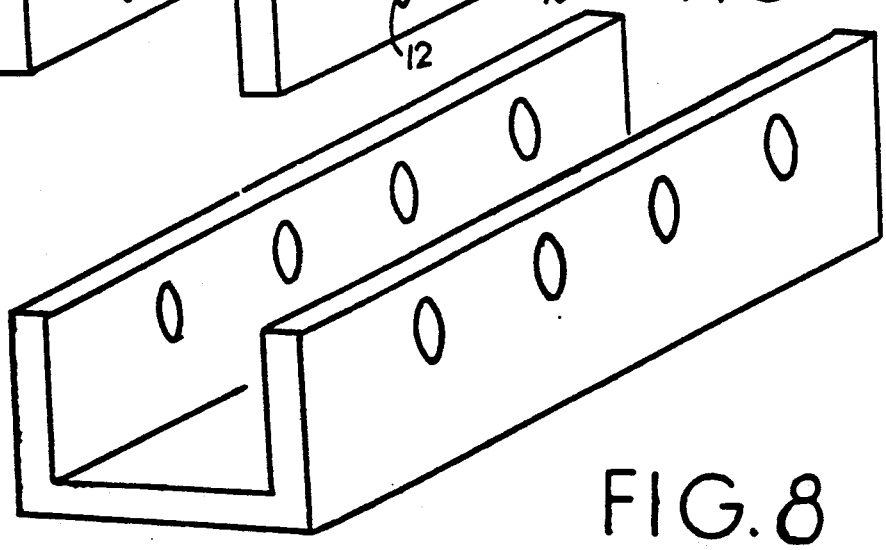
Figure 9:
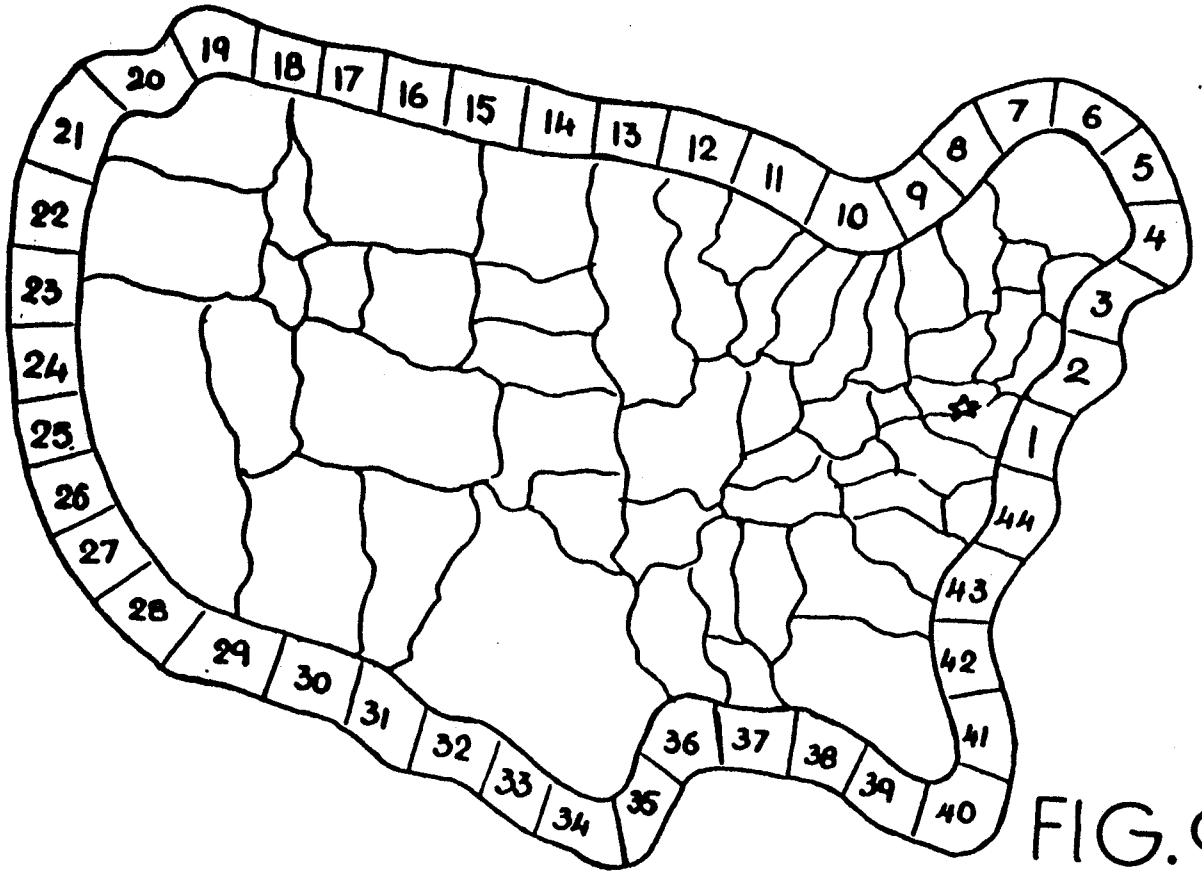
FIG. 9 shows 44 hangers being connected together fixed on a map of the United States of America with its capital and states.
Figure 10:
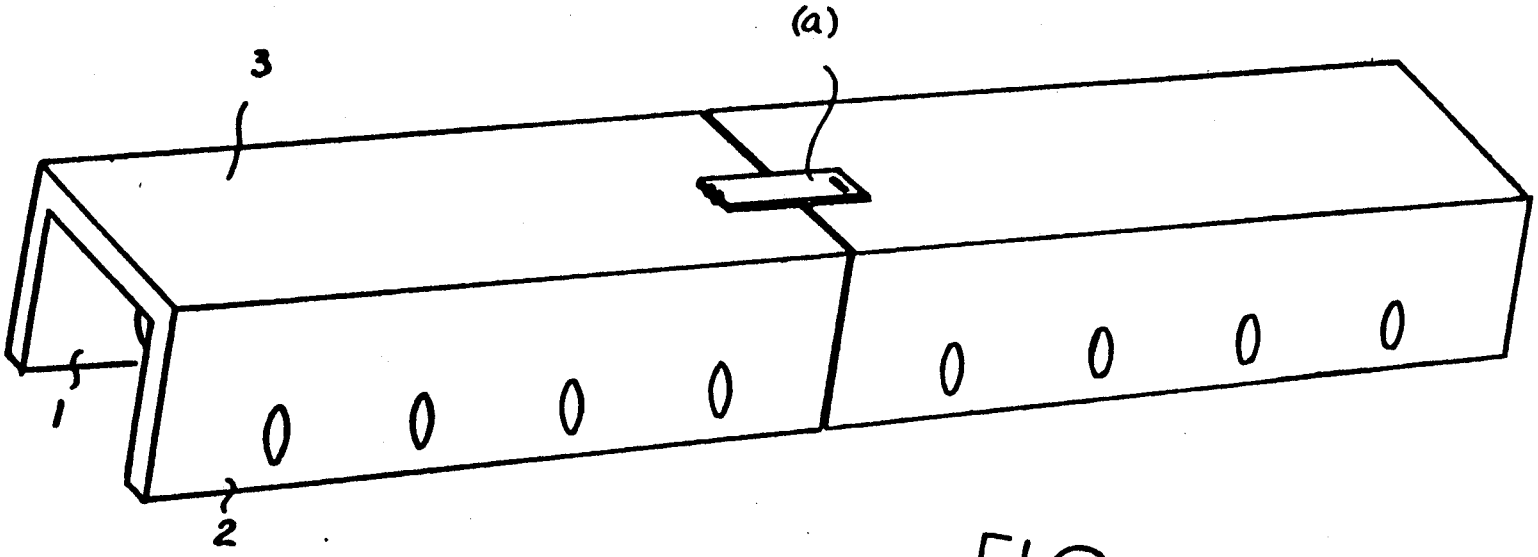
FIG. 10 shows a connection of two hangers.

FIG. 1 shows a cut-away diagram of hanger with its sides 1, 2 and its back 3. The hanger has a shape of the word C with two bars in FIG. 2 (FIGS. 4, 5, and 6) containing tracks 4, 5 on them attached to sides 1, 2 by links 6, 7 (8, 9, 10, and 11) put through holes 12, 13, 14, and 15 of sides 1, 2 in FIG. 7. FIG. 3 is a cut-away hanger with two bars containing tracks 4, 5 on them. FIG. 4, FIG. 5, and FIG. 6 show a bar which is drawn in three-dimensional figures. FIG. 7 and FIG. 8 show a hanger which is also drawn in three-dimensional figures. By hanging on a hook fixed on a ceiling or on pole connected with six small cables, the back of connecting to the border of the map of the United States of America through hooks on the small tube along the boundary of each state faces ceiling and let players see the map of the United States of America and its states with boundaries, made of small tubes. There are 44 pieces of hanger. Each piece of hanger has particular area of the shape of the U.S. map in FIG. 9. Pieces of hanger are to be put together by their tracks and a small lock (a) on the outside back 3 of hanger at their ends in FIG. 10.

Figure 11:
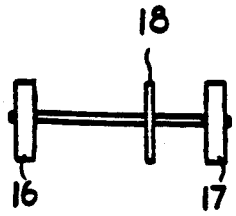
FIG. 11 shows wheels with its axle.
Figure 11A:
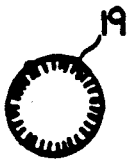
FIG. 11*a* shows teeth on a wheel.

FIG. 11 shows wheels in which two outer wheels 16, 17 and the middle wheel 18 is run by touching with a wheel 20 of a motor 21. Wheel 18 has one side with teeth 19 touching teeth of wheel 20 of motor 21, when restored power, motor runs that make the middle wheel 18 run and wheels 16, 17 also run along the pathway on bars of hanger.

Figure 12:
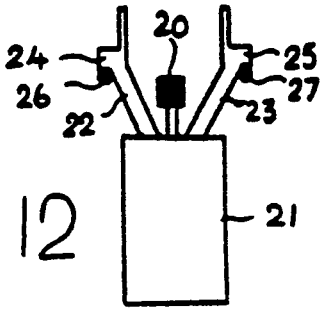
FIG. 12 shows the upper motor with its hands.
Figure 13:
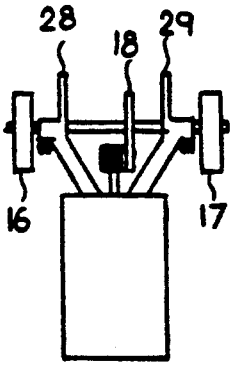
FIG. 13 shows a complete installation of wheels and upper motor.
Figure 14:
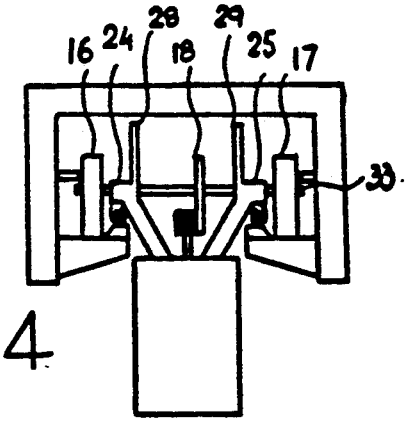
FIG. 14 shows a complete installation of hanger, wheels, and upper motor.

Referring now to FIG. 12 is a motor 21 connected by two links 22, 23 to two hands 24, 25. Below two hands 24, 25 are two electrical wired brushes 26, 27 always touching two rails 4, 5 which allow power to run the top motor 21. FIG. 13 is assembled by FIG. 11 and FIG. 12. FIG. 14 is assembled by FIG. 3 and FIG. 13. Moreover a flat, hollow tube 30 containing a flat, flexible plastic string 31 inside and both are connected with the other end of motor 21 by a small hook 32 hanging them over. As FIG. 14 shows that an axle 33 is used to connect two outer wheels 16, 17 and the middle wheel 18 to two hands 24, 25 on both sides of the middle wheel 19. When wheels and axle turn around and run, they carry these hands 24, 25 and the top motor 21 below them, but hands 24, 25 do not turn around and stay upward with two tips 28, 29 straight up. These two hands 24, 25 hold two metal tips 28, 29, standing up, touching metal pieces 70*a*, 70*b*, . . . on the inside back of hanger which allows power to run a small motor (A) put inside the body of the plane.

Figure 15:
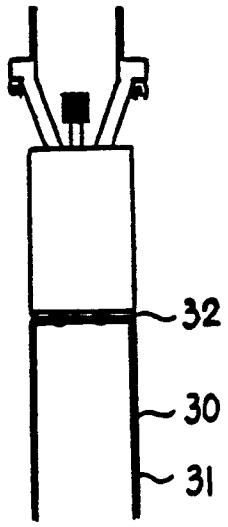
FIG. 15 shows a flexible string attached to upper motor.
Figure 16:
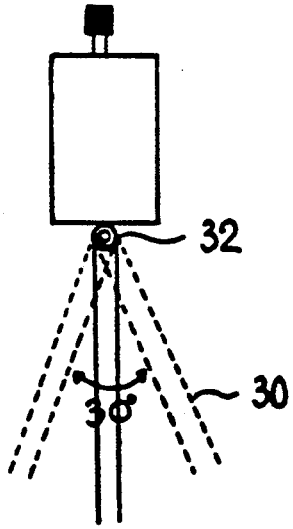
FIG. 16 shows movement of flexible string.
Figure 17:
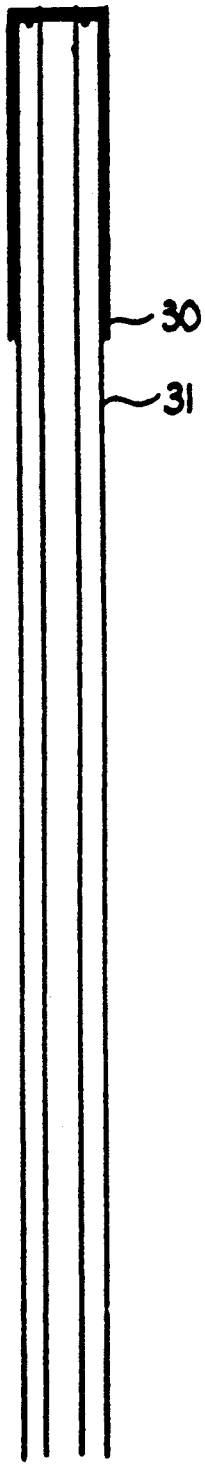
FIG. 17 shows flexible string and its supportable tube.
Figure 18:
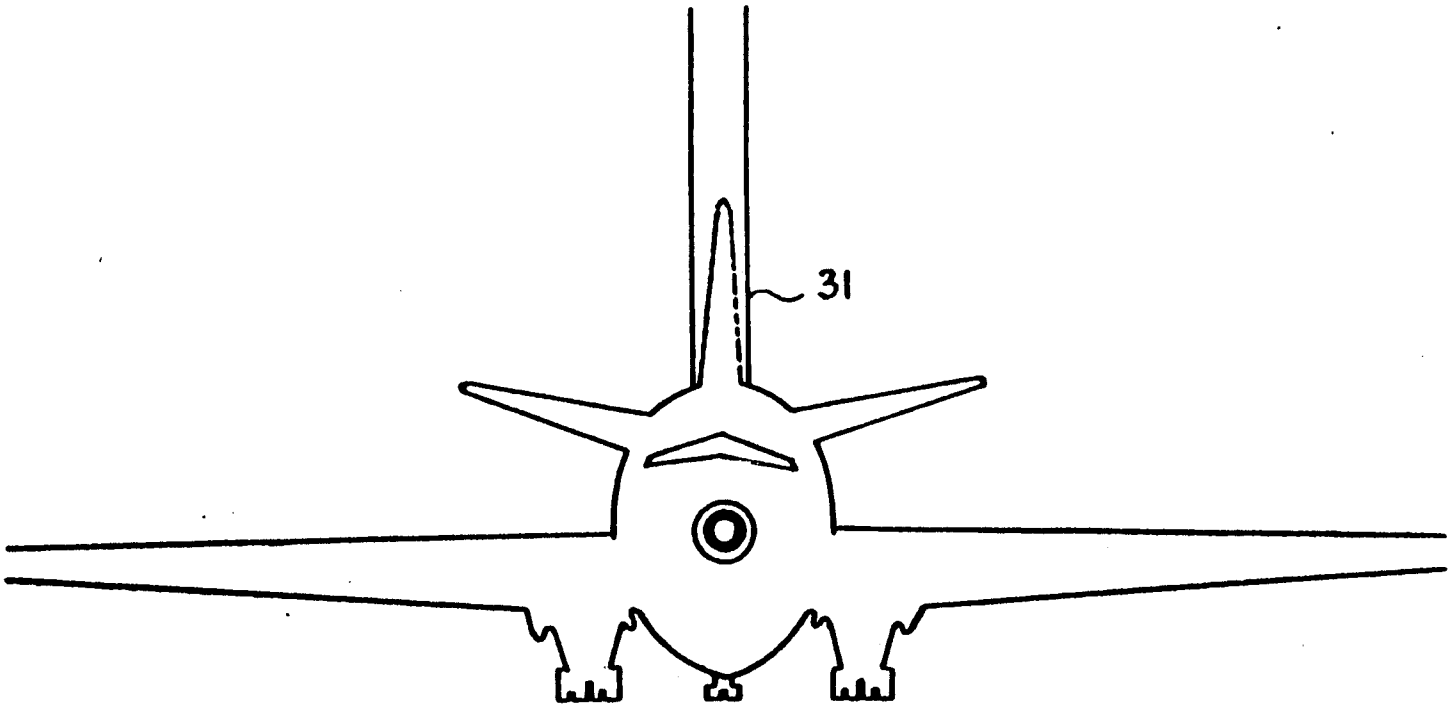
FIG. 18 shows flexible string and aircraft.
Figure 19:
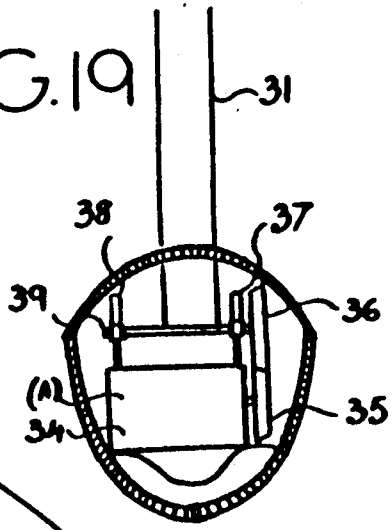
FIG. 19 shows a flexible string and the structure of the motor in the fuselage.
Figure 20:
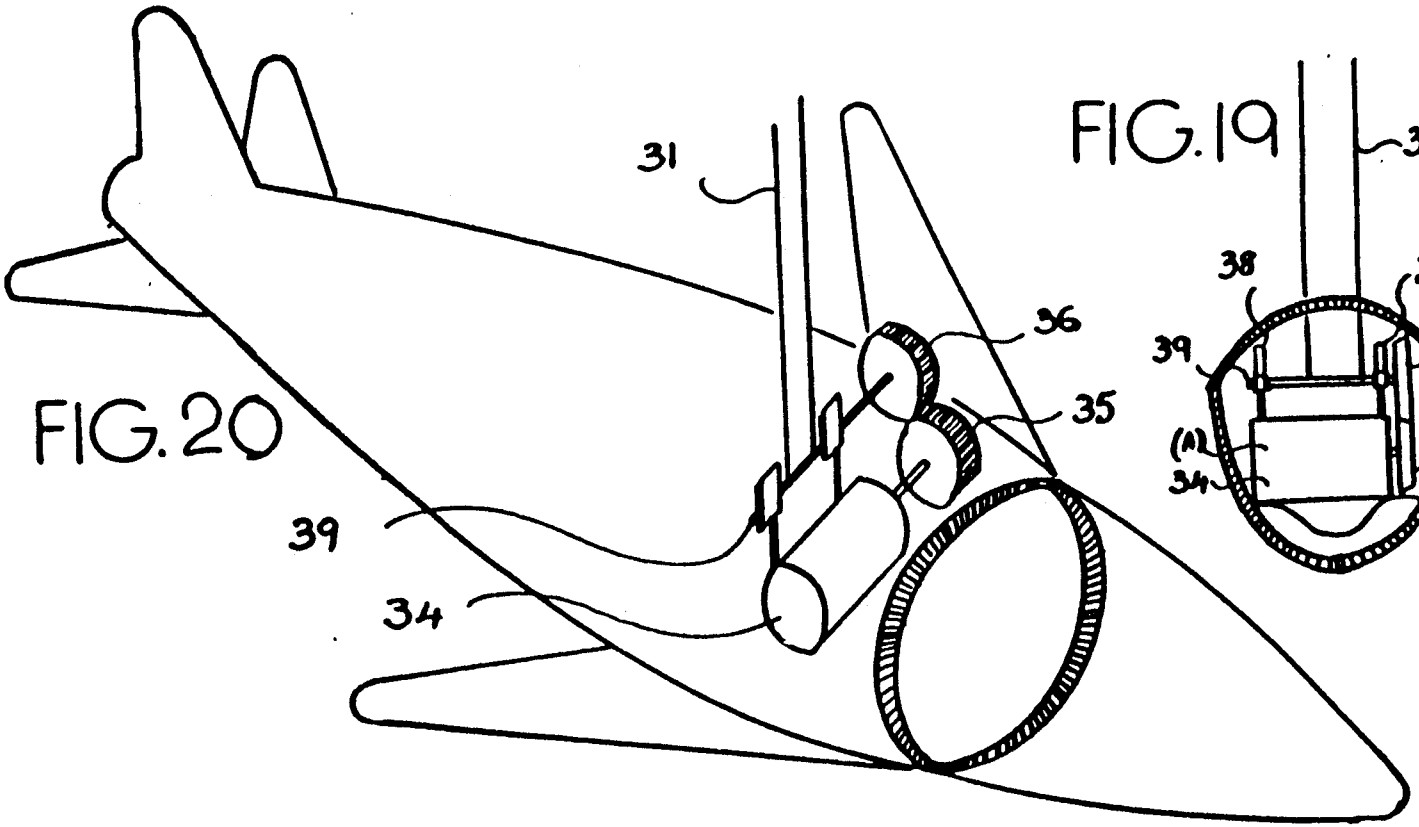
FIG. 20 shows the structure of the motor in fuselage in three dimensions.
Figure 21:
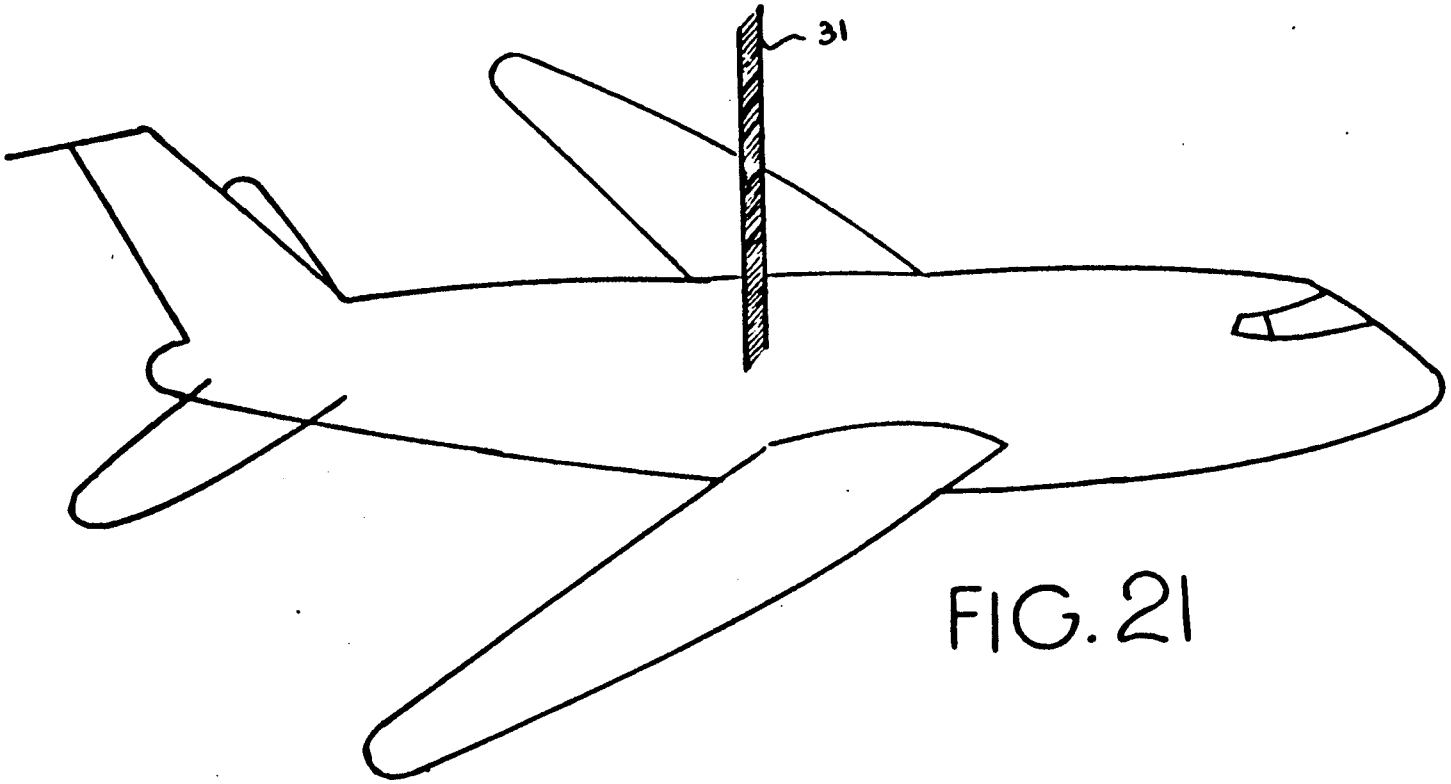
FIG. 21 shows an aircraft hung by a flexible string.
Figure 24:
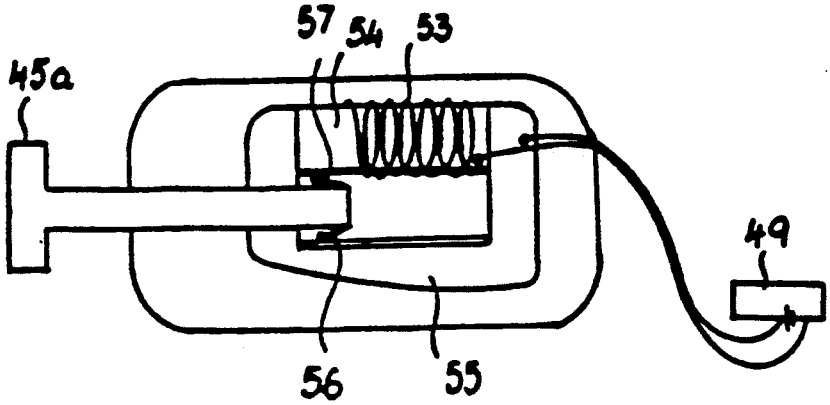
FIG. 24 shows the structure of a hand remote control.
Figure 25:
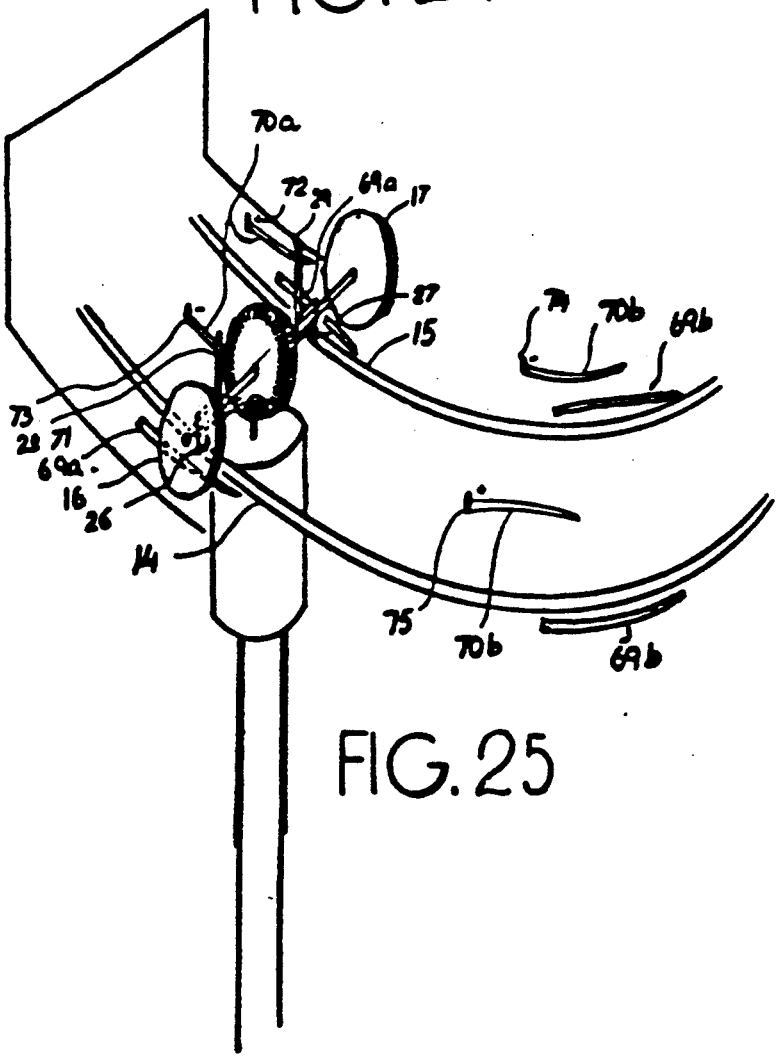
FIG. 25 shows the structure of metal pieces, metal logs, tracks, wheels, upper motor in a hanger, and joint spots.
Figure 26:
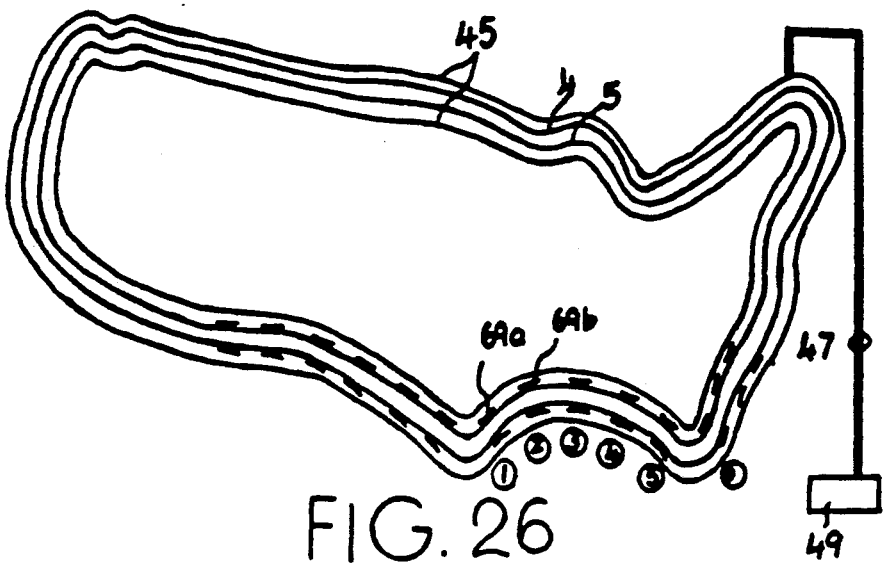
FIG. 26 shows the structure of metal logs along tracks in hanger.
Figure 27:
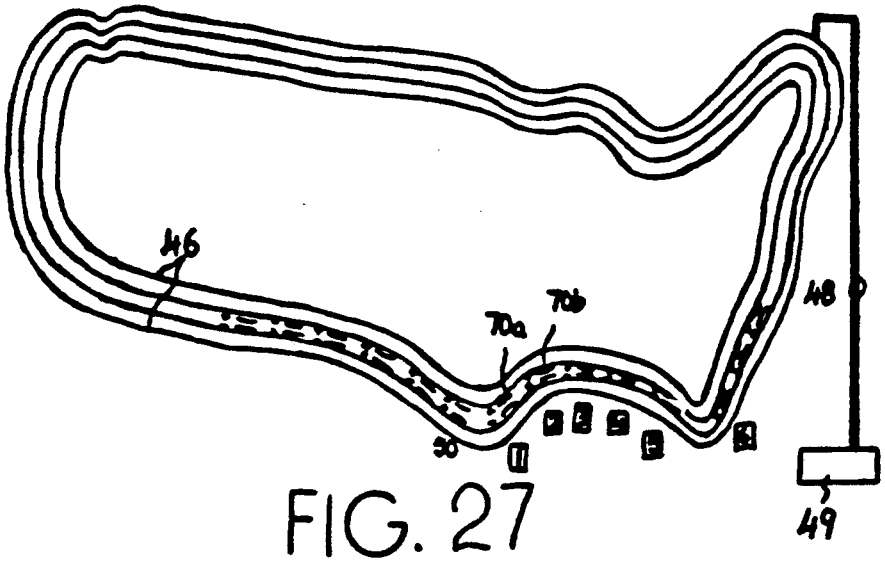
FIG. 27 shows the structure of metal pieces hung over the tracks.
Figure 28:
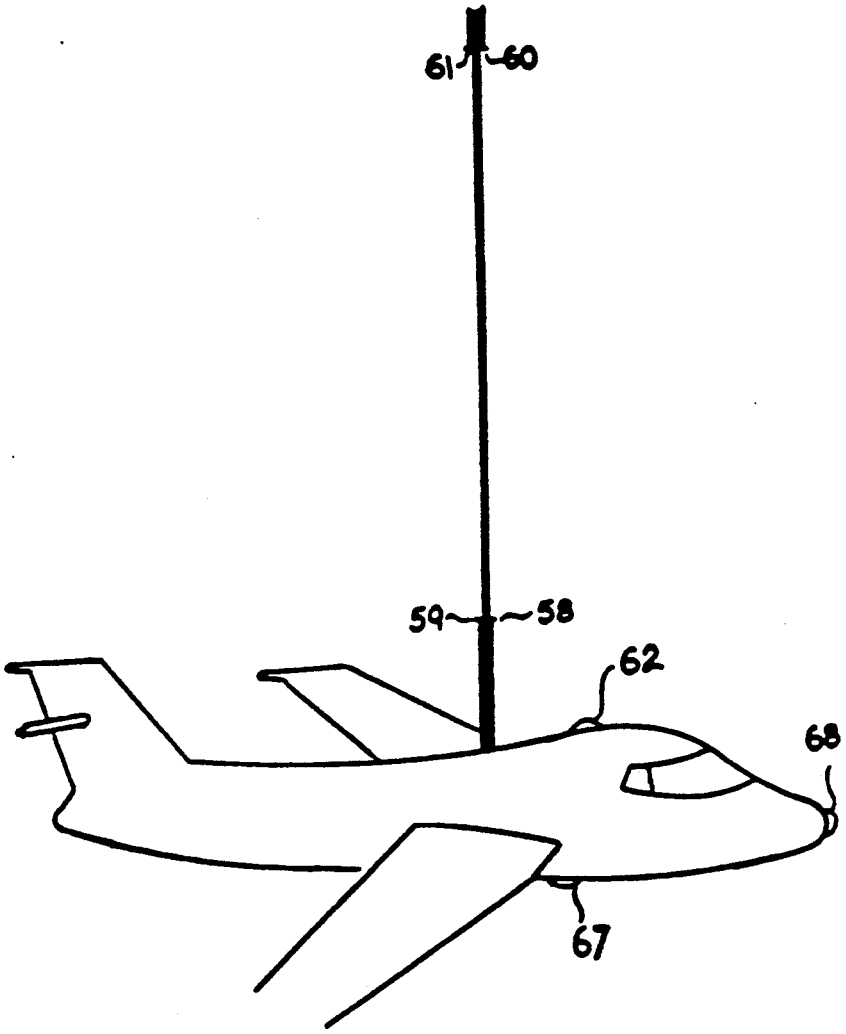
FIG. 28 shows how light on top to be flashed.
Figure 29:
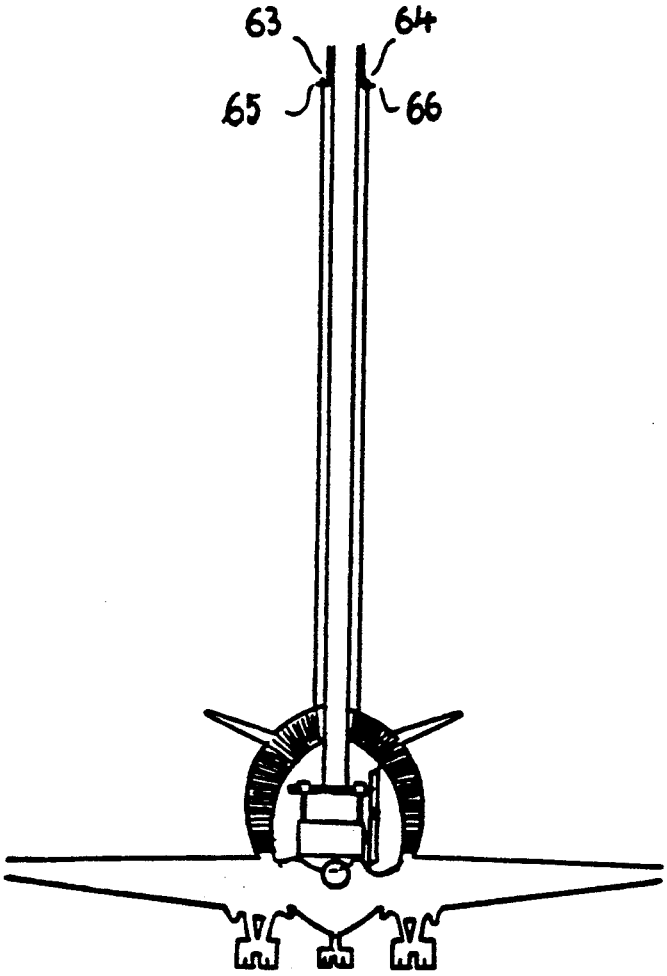
FIG. 29 shows how light at bottom to be flashed.

FIG. 15, FIG. 16, and FIG. 17 show the flat, hollow tube 30 containing a soft flexible plastic string 31 inside can swing back and forth with an angle 30° by a small flat hook at the ends of the flat tube and top motor, to make plane easily fly. This string 31 also contains electric wires connecting metal tips 28, 29 with motor (A) in the body of airplane. This tube 30 is about 12 inches long which is designed to keep the string 31 from swinging around. The string is about 5 feet long including the one inside tube 30. Its width is about ½ inch. It is made of soft, very flexible, transparent plastic. Electrically weaved-brush wires are used inside the string to make it easily roll back and forth and is hardly broken. FIG. 18 shows a front view of aircraft hung by sat ring 31. FIG. 19 denotes the structure of motor (A) with its axle 39 inside the body of the plane. FIG. 20 shows another view of motor (A) in fuselage in three-dimensional perspective. FIG. 21 is a side view of a hung airplane. FIG. 22 and FIG. 23 display a hung map with wires 45 giving power for flight and 46 giving power for altitude of aircraft when buttons 45*a* and 46*a* are pressed respectively. Electric wires 47, 48 are used to connect wires 45, 46 with battery box 49. Wires 51, 52 connect battery box 49 to a remote control with two buttons 45*a* and 46*a*. Wires 45, 47, 51 and button 45*a* are for flight. Wires 46, 48, 52, and button 46*a* are for altitude. Airplane can fly up and down by using an altitude-controlled button 46*a* while plane is given by pressing a flight-controlled button 45*a*. FIG. 24 shows the structure of a hand-held control. When pressing a button, suppose button 45*a*, logs 56 and 57 touch metal piece 55 and resistance 53 to make a close circuit which gives power to tracks 4 and 5. In FIG. 25 wheels 16, 17 are running because button 45*a* is pressed and electrical brushes 26 and 27 touch tracks 4 and 5, getting power, to make the motor 21 run, wheel 20 turns around, and that make middle wheel 18 run and so do wheels 16 and 17. FIG. 26 displays wires 45, tracks 4, 5, and fifty pairs of metal log 69*a*, 69*b*, . . . at a certain distance along the tracks 4, 5. When wheels 16, 17 run and make metal logs 69*a*, 69*b*, . . . touch rail 4, 5 and make the light of states turn on respectively and when wheels 16, 17 pass each pair, light will be off. Wires are used to make connection from metal logs 69*a*, 69*b*, . . . along tracks 4, 5 to light of states going through small tubes which run along state boundaries. Button 46*a*, is pressed, giving power for wires 46. FIG. 27 shows pairs of metal pieces 70*a*, 70*b*, . . . which are fixed on the inside back of hanger. This structure leads us to a question how plane flies up and down, meaning changing its altitude. Here is the answer. There are fifty metal pieces on each side, one is positive and the next one is negative from wires 46 and it goes on until the fiftieth metal piece, The other side also has fifty pairs of metal pieces creating fifty pairs of metal pieces 70*a*, 70*b*, . . . fixing on the inside back of hanger at a certain distance. But one of the pair is positive, the other must be negative from wire 46 and so on. When wheels 16, 17 run along the pathway of hanger, the metal tips 28, 29 touch each pair of metal pieces 70*a*, 70*b*, . . . while player presses an altitude-controlled button 46*a* causing each pair of metal pieces 70*a*, 70*b*, . . . which gets power from wire 46 and that makes motor (A) in the body of aircraft run. When it is running, the end of motor (A) in fuselage has a small wheel 35 touching another wheel 36 in FIG. 19 that rolls a plastic string 31 to make it shorter at this pair and longer at the next pair and so on, causing plane flies up when the string is shorter and down when it is longer, that happens because pair of metal pieces 70*a* has a positive #72 and a negative #73 that could make motor (A) run this direction and while next pair of metal pieces 70*b* has a negative #74 and a positive #75 that could make motor (A) run the reverse direction in FIG. 25. In FIG. 28 the highest altitude is reached when light 62 on the top of plane is lit which warns player not to fly higher. The light 62 is on because antennas 58, 59 touch the flat tube 30 at points 60, 61. Plane reaches a lowest altitude when the light 67 at the bottom of plane is on. In FIG. 29 antennas 63, 64 points the flat tube 30 at points 65, 66 causing light 67 is on. When flying around beneath the map of the United States of America in FIG. 30 and FIG. 31, wheels 16, 17 run along the pathway of hanger in FIG. 25 touch 69*a* that makes light of one state on; and also metal tips 28, 29 touch metal pieces 70*a*, 70*b*, . . . causing aircraft flies up and down that means changing altitude when button 46*a* is pressed. This also causes the light 68 at nose of plane on.

Figure 30:
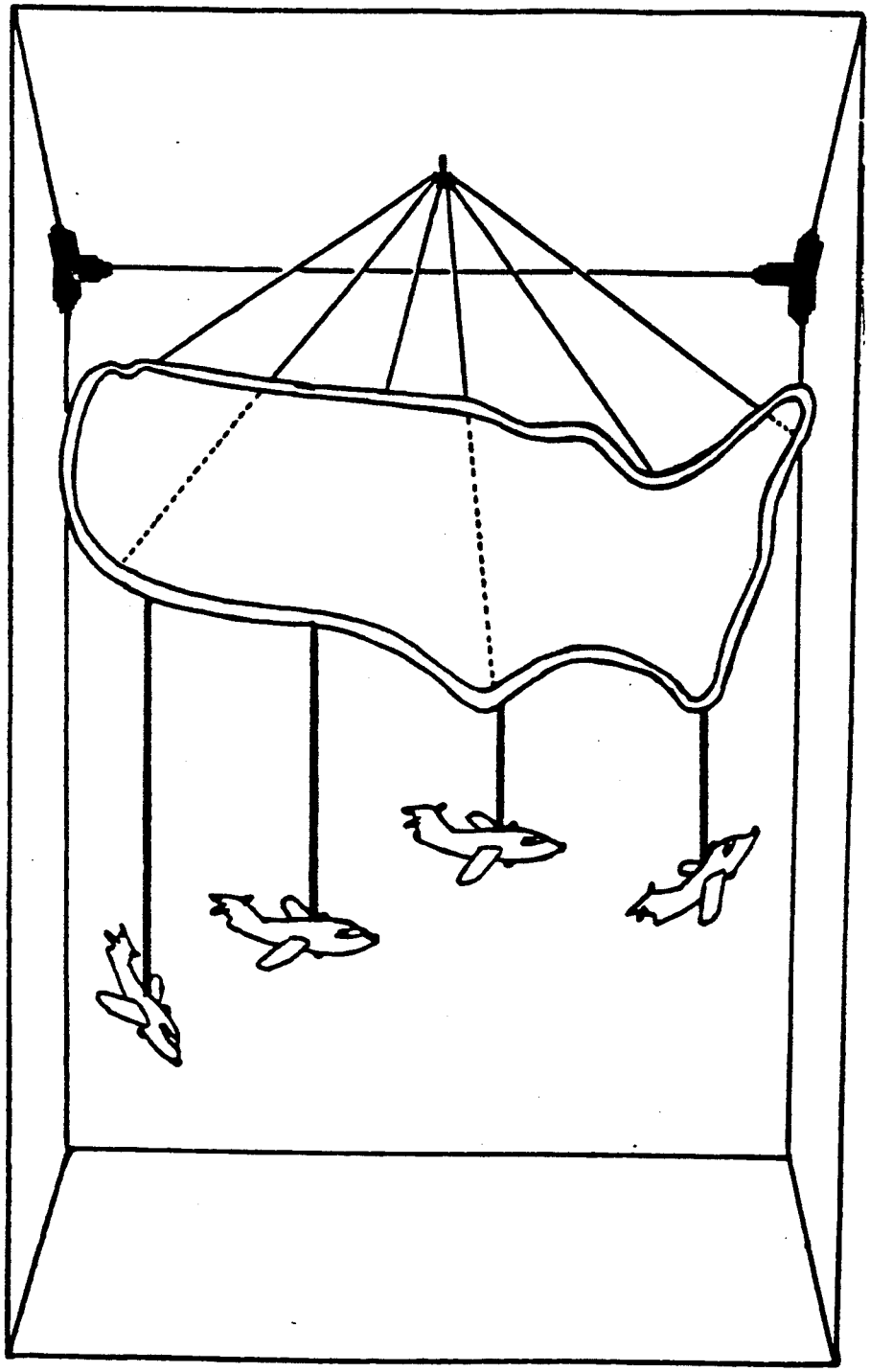
FIG. 30 shows a perspective view of the instant invention as disposed in a conventional room.
Figure 31:
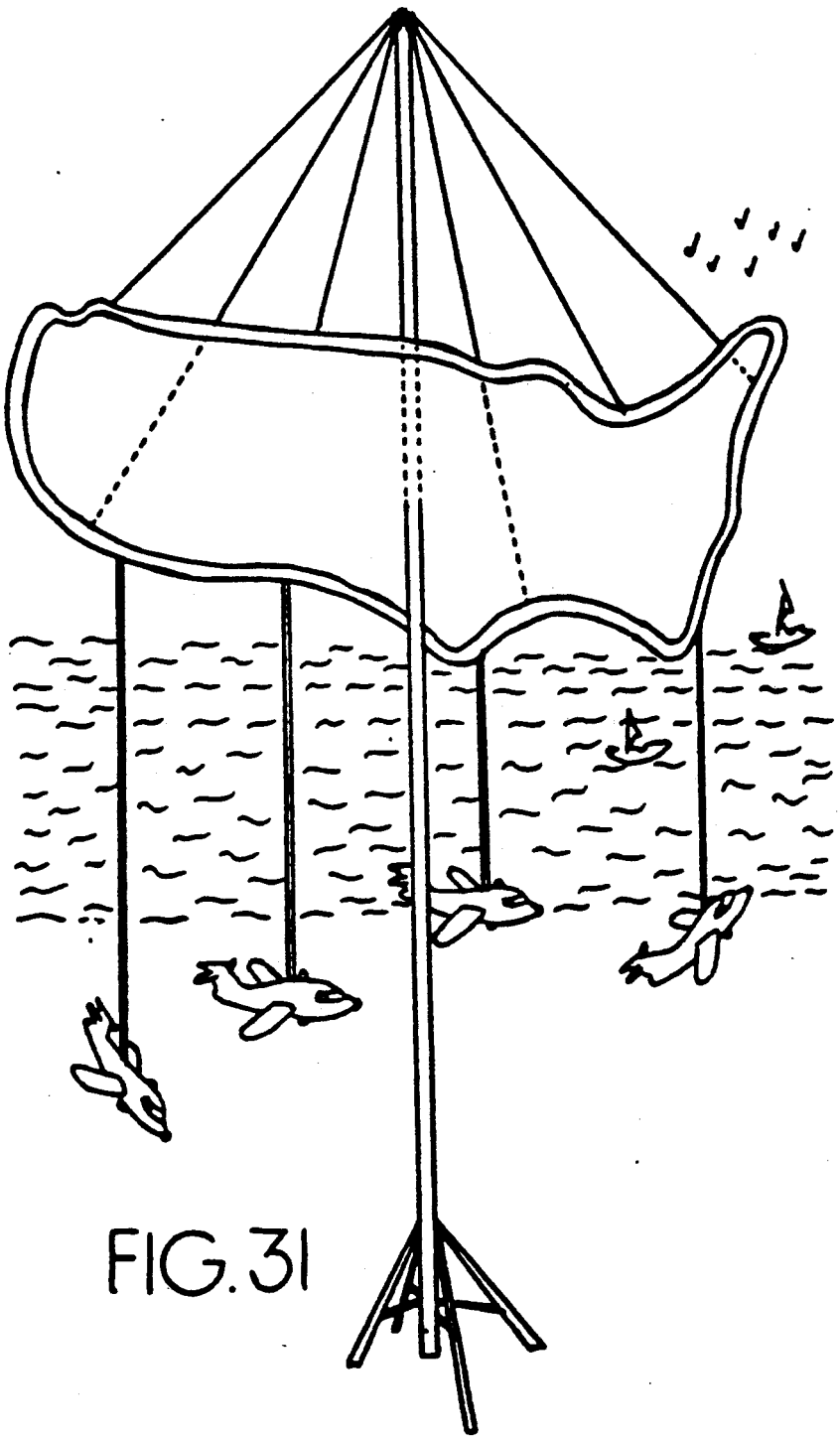
FIG. 31 shows a perspective view of the instant invention as operated outdoors.
Figure 32:
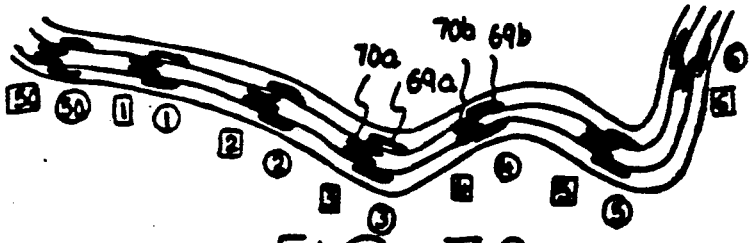
FIG. 32 shows a structure of metal pieces, metal logs, joint spots of metal pieces and metal logs in hanger.
Figure 33:
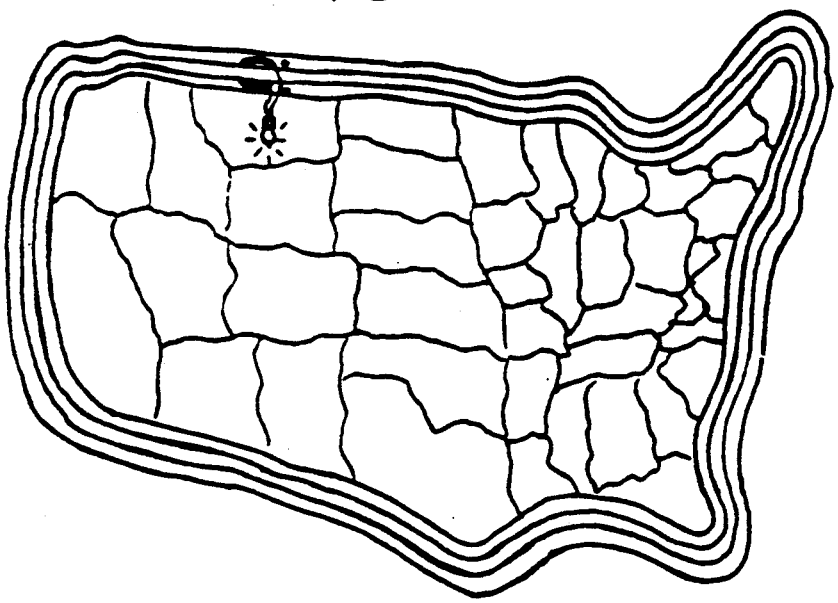
Figure 33A:
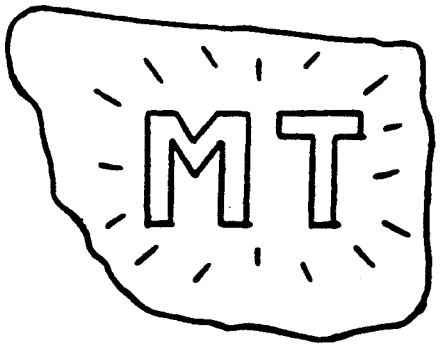
Figure 34:
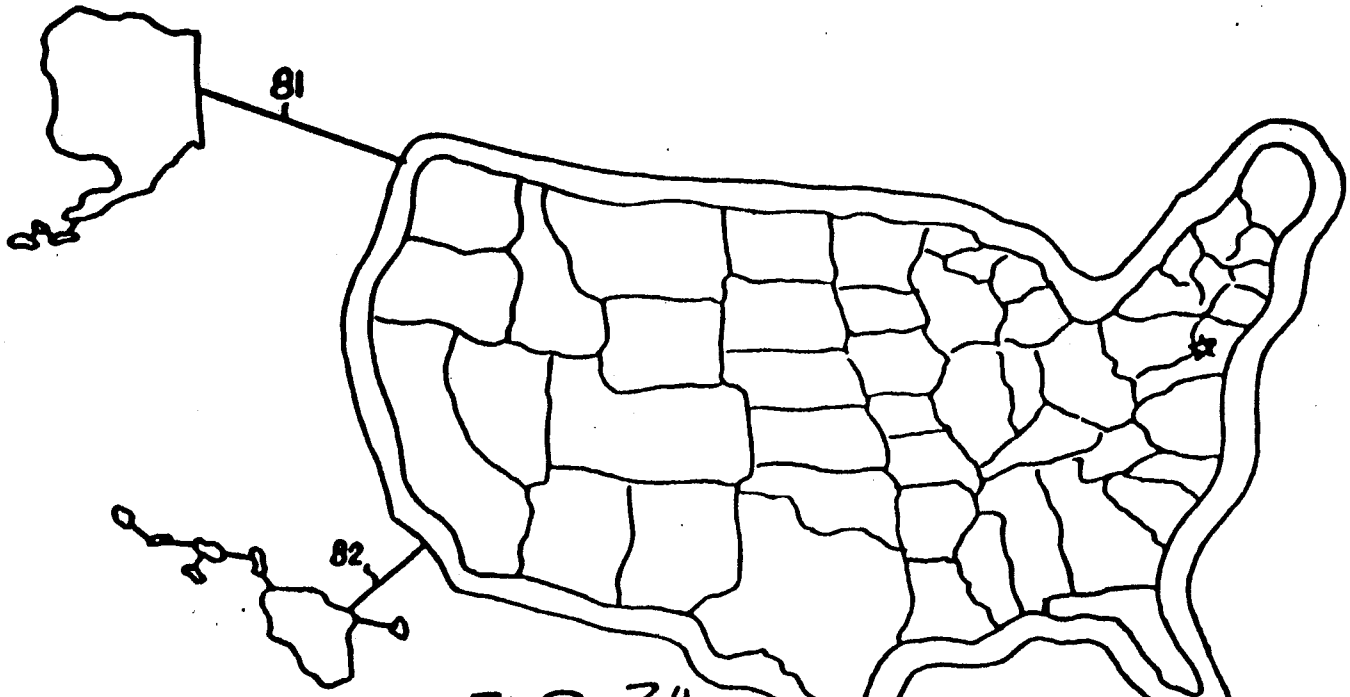
FIG. 34 shows a structure of the map with all of the states.
Figure 35:
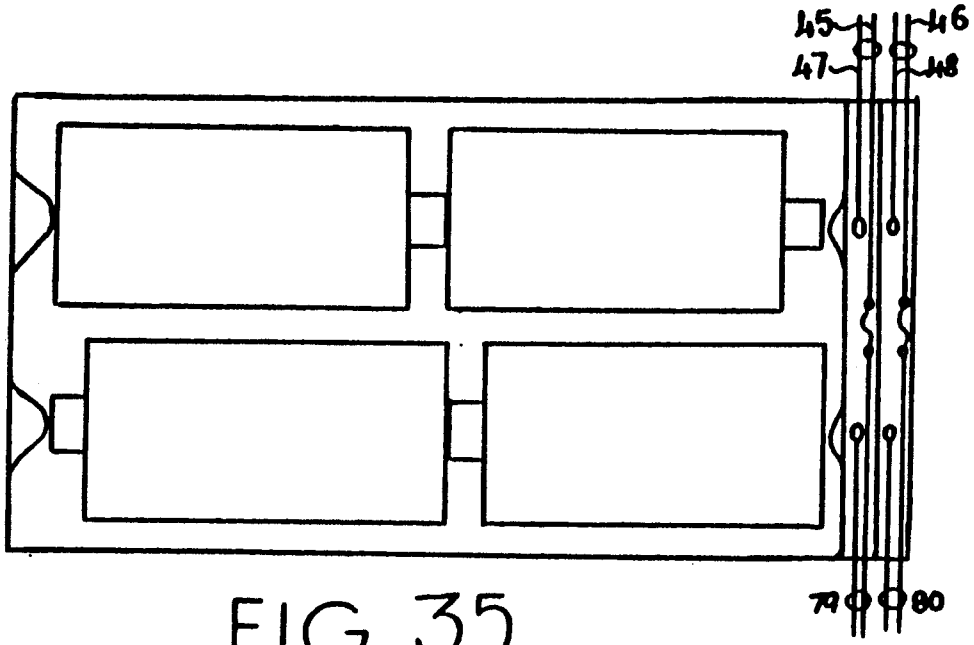
FIG. 35 shows a structure of battery box.
Figure 36:
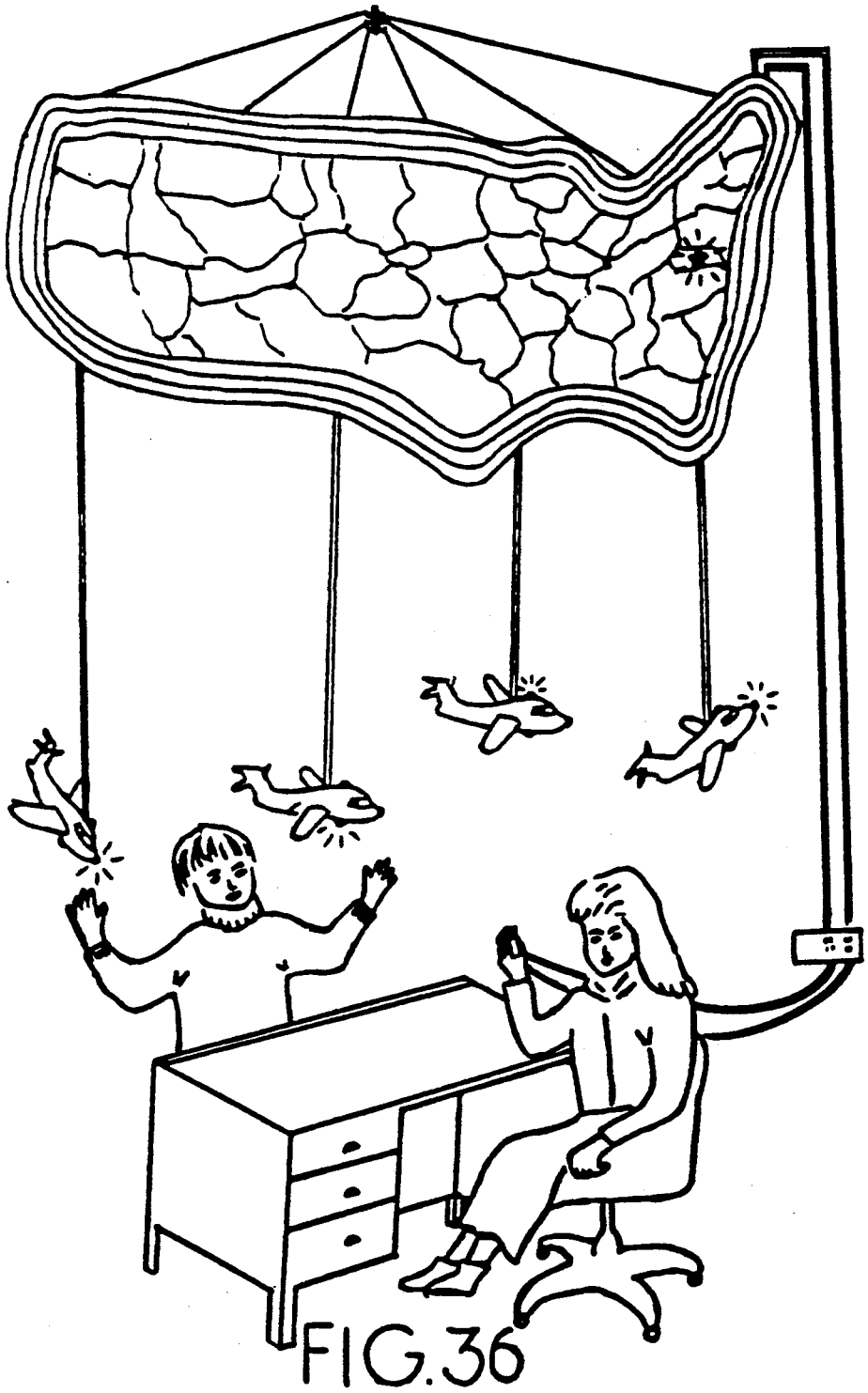
FIG. 36 shows a perspective view of two operators and the instant invention as operated indoors or outdoors.

Now we take a look how aircraft flies at the highest altitude, the light 62 on top is on and the light at nose is flashing. When aircraft stops flying on the lowest altitude at a special spot, meaning landing, that could make the lights on the bottom on and at the nose of plane flash, and also light of one state flash, that means player makes a right landing at a chosen state by another player or by self and wins. This happens because FIG. 25 shows pair of metal pieces 70*a* and pair of metal logs 69*a* have a joint spot that means when tips 28, 29 touch metal pieces 70*a* at the same time wheels 16, 17 hit metal logs 69*a* at a joint spot. Passing over a joint spot, only wheels 16, 17 hit metal logs of one state on, or not reaching a joint spot yet, metal tips 28, 29 only touch metal pieces 70*a* causing the lights on the bottom on and at the nose of aircraft flash at the lowest altitude, meaning making a wrong landing. FIG. 30 and FIG. 31 also show that aircraft can fly in a room or can be operated on the beach. FIG. 32 shows part of south border with pairs of metal pieces 70*a*, 70*b*, . . . along the inside back of hanger and pairs of metal logs 69*a*, 69*b*, . . . along tracks 4, 5 and their joint spots. When aircraft makes one round it will make light of each state flash respectively showing the name of that state, such as NY, VA, CA, or MT. . . in FIG. 33. There are fifty lights for fifty state names. The light of the name of the capital Washington, D.C. will be lit all the time. The map of Alaska and Hawaii will be connected with mainland by transparent plastic sticks 81, 82 on the left side of the map in FIG. 34. FIG. 35 displays a battery box 49 which supplies power when a hand-held control with two buttons, one for flight and one for altitude, are pressed. FIG. 36 shows a girl sitting on a chair plays the toy game and another player gives her a state name. As we know, the hanger in which wheels will run along the tracks on the pathway of hanger has the shape of the United States map. Each state has its boundary by using small tubes which allow electric wires going inside them. These wires go from each pair of metal logs 69*a*, 69*b*, . . . along tracks 4, 5 to a bulb inside the state name and the small star standing for the capital of each state. The bigger star stands for the capital will be lit all the time. The length of the map is about 4⅛ feet and its width is about 3 feet. Electric wires 45 from tracks and 46 from metal pieces 70*a*, 70*b*, . . . are connected with wires 47, 48 which go to a battery box. Two pairs of electric wires 51, 52 go to a hand control, one for flight button and one for altitude button from battery box.

This is not only a toy but also a game showing where the location of each state is and how to land on a state chosen by another player or by self. It is considered a winner who can stop flying aircraft at a particular spot, that means landing which makes light of a chosen state and two other lights, one on the bottom and one at the nose of aircraft, flash on. The light of state is on that means landing on a right state. The light on the bottom is on that means plane reaching the lowest altitude and the light at the nose is on meaning a landing is complete. We think players who participate in playing this game will remember the location of every state. Also, time is an important feature. This decisive factor is the one who has the shortest period of time is considered a winner, that means a player must fly his plane faster than the others. We would like to be allowed that the size of the toy game could be changeable because of the manufacturing cost. Also, other maps of countries, intercontinental map, or planets in space are going to be utilized for the toy game in this manner.

What is claimed is:

1. An aircraft flying game comprising; a model aircraft; a map of a desired area; a pathway for moving wheels provided along a predetermined portion of the map; an upper motor in mechanical communication with a carriage comprising a pair of wheels which are positioned in the pathway for moving wheels; power means for said upper motor; means for hanging the model aircraft from the carriage such that the model aircraft will move along underneath the predetermined portion of the map when the wheels are motorized; a lower motor located inside the model aircraft in mechanical communication with means provided for changing the vertical position of model aircraft in relation to the border of the map; power means for said lower motor; said hanging means comprising tube means containing therein flexible tether means with the winding or unwinding of which will raise or lower the vertical position of the aircraft with said hanging means preventing the undesired rotation of the aircraft; means for controlling said upper motor and said lower motor such that the model aircraft's position may be varied both with respect to the position on the map from which it is hung as well as changing its vertical position in relation to the map.

2. An aircraft flying game as claimed in claim 1 wherein the map is of the mainland United States and comprises a map of Alaska and Hawaii positioned adjacent thereto and wherein the pathway for moving wheels does not extend along outer border of the maps of Alaska and Hawaii but only along the outer border of the map of the mainland United States.

3. An aircraft flying game as claimed in claim 1 wherein the map of the mainland United States further comprises maps of Alaska and Hawaii adjacent thereto and wherein the pathway of moving wheels extends along the outer border of the maps of the mainland United States.

4. The aircraft flying game as claimed in claim 1 wherein said tube means comprises at least two sections, the first section coupled to the carriage, the second section coupled to the aircraft, and the tether disposed therein.

5. The aircraft flying game as claimed in claim 4 wherein said tube means comprises a flat hollow tube and said tether comprises flat flexible electrical wire for coupling mechanically and electrically said aircraft with the carriage.

6. The aircraft flying game as claimed in claim 1 which includes means for suspending said map from a ceiling.

7. The aircraft flying game as claimed in claim 1 which includes means for suspending said map from a pole support and the like.

8. An aircraft flying game comprising; a. a board, b. a map of the mainland United States depicted on said board, c. means for suspending said board with a map on the underside thereof and surrounding the periphery of said map, e. a carriage for traveling along said track, f. means suspending a model aircraft from said carriage, g. means for adjusting the vertical distance of said aircraft from said carriage, h. electrical means for driving said carriage along said track and for controlling the speed thereof, and for controlling the means for adjusting the vertical distance of said aircraft from said carriage, i. a light at the location of a selected geographical area within each state on said map, j. a pair of electrical contacts on said track for each light, pairs of said contacts being spaced along said track, k. an open electric circuit including an electric power source connecting each of said lights to a pair of said contacts, l. means on said carriage for bridging each pair of contacts in turn as said carriage travels along said track to close said electric circuits and light said lights, m. a light on said aircraft; and n. means for actuating said light on said aircraft when said plane is a selected vertical distance from said carriage whereby a game may be played in which each player attempts to "land" the aircraft at a selected geographical location by moving said aircraft along the track and vertically, and causing said plane to come to rest with the carriage in position to light the light at that geographic location and with the aircraft at the proper vertical distance from the carriage to light the light on the aircraft.

9. An aircraft flying game as claimed in claim 8 wherein the map of the mainland United States further comprises maps of Alaska and Hawaii positioned adjacent thereto and wherein the track attached to said board does not surround the periphery of the maps of Alaska and Hawaii but only surrounds the periphery of the map of the mainland United States.

10. An aircraft flying game as claimed in claim 8 wherein the map of the mainland United States further comprises maps of Alaska and Hawaii positioned adjacent thereto and wherein the track attached to said board surrounds the periphery of the maps of Alaska and Hawaii as well as surrounding the periphery of the map of the mainland United States.

11. The aircraft flying game as claimed in claim 8 which includes means for suspending said board from a ceiling.

12. The aircraft flying game as claimed in claimed 8 which includes means for suspending said board from a pole and the like.

13. An aircraft flying game comprising: a model aircraft; a map; a track for wheels provided along a predetermined path of the map; a carriage comprising a pair of wheels positioned in the track such that the pair of wheels can freely roll in the track; means for hanging the model aircraft from the carriage such that the model aircraft will move along the predetermined path of the map when the pair of wheels rolls and such that the vertical position of the aircraft may be changed with relation to the map; first motor means for motorizing the pair of wheels such that they roll in the track; said hanging means comprising tube means containing therein flexible tether means with the winding or unwinding of which will raise or lower the vertical position of the aircraft with said hanging means preventing the undesired rotation of the aircraft; means for adjusting the hanging means such that the vertical position of the aircraft may be changed with relation to the map; said adjusting means including second motor means for taking or letting out a predetermined amount of said tether means so as to adjust the position of the aircraft with respect to the map.

14. An aircraft flying game as claimed in claim 13 further comprising means for controlling the means for motorizing the pair of wheels and means for controlling the means for adjusting the hanging means.

15. The aircraft flying game as claimed in claim 13 wherein said tube means comprises at least two sections, the first section coupled to the carriage, the second section coupled to the aircraft, and the tether disposed therein.

16. The aircraft flying game as claimed in claim 15 wherein said tube means comprises a flat hollow tube and said tether comprises flat flexible electrical wire for coupling mechanically and electrically said aircraft with the carriage and the like.

17. The aircraft flying game as claimed in claim 13 which includes means for suspending said map from a ceiling.

18. The aircraft flying game as claimed in claim 13 which includes means for suspending said map from a pole and the like.

19. An aircraft flying game comprising:

a model aircraft;

a map;

a hanger attached to said map and positioned along a predetermined path thereof; an upper motor in mechanical communication with a pair of wheels positioned in the path for moving said wheels; power means for said upper motor;

means for hanging the model aircraft from the pair of wheels by flexible means such that the model aircraft will move along the predetermined path on the map when the wheels are motorized;

a lower motor located inside the model aircraft in mechanical communication with means provided for changing the vertical position of the model aircraft in relation to map; power means for said lower motor;

means for controlling said upper motor and said lower motor such that the model aircraft's position may be varied both with respect to the position on the map from which it is hung as well as changing its vertical position in relation to the map;

lights at the location of selected areas on said map;

a pair of electrical contacts for each light, pairs of said contacts being spaced along said predetermined path;

an open electric circuit including an electric power source connecting each of said lights to a pair of said contacts;

means for bridging each pair of contacts in turn as said aircraft travels along said predetermined path to close said electric circuits and flash said lights;

lights on said aircraft;

means for actuating said light on said aircraft when said aircraft is a selected vertical distance from said map whereby a game may be played in which each player attempts to land aircraft at a selected geographical location and when the aircraft at the proper vertical distance from the map to flash the light on the aircraft; and means for controlling the distance of travel of the aircraft on the predetermined path and the distance of the aircraft from the map.

* * * * *